US012766587B2

(12) United States Patent
Scholey et al.

(10) Patent No.: US 12,766,587 B2
(45) Date of Patent: Oct. 20, 2026

(54) CERAMIC PUSH PAD FOR CAN NECKING MACHINE

(71) Applicant: Stolle Machinery Company, LLC, Centennial, CO (US)

(72) Inventors: Ian Kenneth Scholey, Barnsley (GB); Stephen Dane Christensen, Highlands Ranch, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 147 days.

(21) Appl. No.: 18/990,287

(22) Filed: Dec. 20, 2024

(65) Prior Publication Data

US 2026/0175284 A1 Jun. 25, 2026

(51) Int. Cl.
*B21D 51/26* (2006.01)

(52) U.S. Cl.
CPC ..... *B21D 51/2638* (2013.01)

(58) Field of Classification Search
CPC B21D 51/2638; B21D 51/2692; B21D 43/04; B21D 43/13; B21D 22/28; B21D 43/18
See application file for complete search history.

(56) References Cited

U.S. PATENT DOCUMENTS 5,282,375 A 2/1994 Lee, Jr. et al.
7,841,222 B2 11/2010 Cook et al.
11,370,015 B2 * 6/2022 Mercer ..... B21D 51/2692
11,565,303 B2 1/2023 Mercer et al.
2009/0010720 A1 1/2009 Schwartz et al.
2021/0039424 A1 2/2021 Bartoo
2021/0394248 A1 * 12/2021 Kumagai ..... B21D 22/28
2024/0033587 A1 2/2024 Henrikson et al.
2024/0034278 A1 2/2024 Herse et al.
2024/0335871 A1 * 10/2024 McKinney ..... B21D 51/2638
2024/0342783 A1 * 10/2024 Wedrychowicz ..... B21D 22/28

FOREIGN PATENT DOCUMENTS

WO 8402667 7/1984

OTHER PUBLICATIONS

U.S. Patent and Trademark Office, ISA/US, PCT Application No. PCT/US2025/058060 International Search Report, Feb. 17, 2026, 14 pages.

* cited by examiner

*Primary Examiner* — Bobby Yeonjin Kim
(74) *Attorney, Agent, or Firm* — Stolle Machinery Company, LLC

(57) ABSTRACT

A pusher assembly for use in forming a can body includes a pusher ram having a first end and an opposite second end. The pusher assembly also includes a number of cam followers positioned at or about the first end of the pusher ram for following a cam profile. The pusher assembly further includes a push pad coupled to the second end of the pusher ram, the push pad having a contact surface structured to engage the can body. The contact surface of the push pad includes a ceramic material.

16 Claims, 9 Drawing Sheets

CERAMIC PUSH PAD FOR CAN NECKING MACHINE

FIELD OF THE INVENTION

The disclosed concept relates generally to pusher assemblies for use in forming portions of can bodies and, more particularly, to push pads for use in pusher assemblies. The disclosed concept further relates to pusher arrangements and processing stations employing such pusher assemblies and push pads.

BACKGROUND OF THE INVENTION

Can bodies, such as those commonly used on the food and beverage industries, are typically formed in a bodymaker. That is, a bodymaker forms blanks such as, but not limited to, disks or cups into an elongated can body. A can body includes a base and a depending sidewall. The sidewall is open at the end opposite the base. The bodymaker, typically, includes a ram/punch that moves the blanks through a number of dies to form the can body. The can body is ejected from the ram/punch for further processing such as, but not limited to, trimming, washing, printing, flanging, inspecting, and then placed on pallets which are shipped to a filler. At the filler, the cans are taken off the pallets, filled, ends placed on them, and then the filled cans are repackaged in six packs and/or twelve pack cases, etc.

After being formed by a bodymaker, some can bodies are further formed in a necker machine. Necker machines are structured to reduce the cross-sectional area of a portion of a can body sidewall, i.e., at the open end of the sidewall. That is, prior to coupling a can end to the can body, the diameter/radius of the can body sidewall open end is reduced relative to the diameter/radius of other portions of the can body sidewall. U.S. Pat. Nos. 11,370,015 and 11,565,303, for example, without limitation, describe examples of necker machines upon which embodiments of the present invention improve. Such necker machines include a number of processing and/or forming stations disposed in series. That is, the processing and/or forming stations are disposed adjacent to each other and a transfer assembly moves a can body between adjacent processing and/or forming stations. As the can body moves through the processing and/or forming stations it is processed or formed.

When performing the necking operation of an aluminum beverage can, the surface of the can may be subjected to high stresses. If the aluminum on the can is not coated, or if the stresses resulting from the necking process are sufficiently high to break through the coating, aluminum from the can may come in contact with the push pad used in performing the necking operation. When this occurs, there is a possibility that aluminum will transfer from the surface of the can to the surface of the push pad. If such transfer is not controlled, aluminum can build up on the push pad at an accelerating rate which will inevitably impact can quality.

Such build up is a particular concern with new axially based reforming systems. Conventional reforming systems occur after the necking stages in a necking machine and rely on rotary movement of a reforming roller to reform the dome of a can. In this case, the base rim coating on the bottom of the can remains intact on the stand diameter of the can so that subsequent processing of the container that relies on contact with the stand diameter of the container does not come in direct contact with the aluminum. Conversely, with novel axially based reforming systems, a ram is inserted into the open end of the can to axially deform the dome and produce the desired reform geometry. When this happens, the base rim coating on the bottom of the can is rolled upward such that it is no longer in contact with the stand diameter of the can. This can be problematic for subsequent processing stages of the container that rely on contact with the stand diameter of the can since bare aluminum is now exposed at the stand diameter. Additionally, axial reform systems generally perform the reforming operation prior to the necking stages in a necking machine, and the necking stages rely heavily on contact between the push pad and stand diameter of the can so aluminum build up on the push pad in this case is a specific concern.

SUMMARY OF THE INVENTION

These concerns, and others, are met by aspects of the discloses concept. As a first aspect of the disclosed concept, a push pad for use in forming a can body is provided. The push pad comprises: a contact surface structured to engage the can body, wherein the contact surface comprises a ceramic material.

The push pad may be a unitary body comprising the ceramic material. The push pad may comprise a base body formed from a non-ceramic material, wherein the contact surface is a permanent coating on the base body.

The push pad may comprise: a base body; and a number of removeable portions selectively coupled to the base body, wherein the number of replaceable portions comprises the contact surface. The number of removeable portions may comprise a single, disc-shaped element.

As another aspect of the disclosed concept, a pusher assembly for use in forming a can body is provided. The pusher assembly comprises: a pusher ram having a first end and an opposite second end; a number of cam followers positioned at or about the first end of the pusher ram, the number of cam followers structured to follow a cam profile; and a push pad such as previously described.

As a further aspect of the disclosed concept, a pusher arrangement for use in forming a can body is provided. The pusher arrangement comprises: a linear motion guide comprising: a number of rail members; and a slider block slidingly coupled to the number of rail members so as to be readily translatable along the number of rail members; and a pusher assembly such as previously described.

As yet another aspect of the disclosed concept, a processing station for forming a portion of a can body is provided. The processing station comprises: a frame; a turret rotatably coupled to the frame and selectively rotatable about a rotation axis; a cam body rigidly coupled to the frame, the cam body having a portion defining a cam profile; and a pusher arrangement such as previously described.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
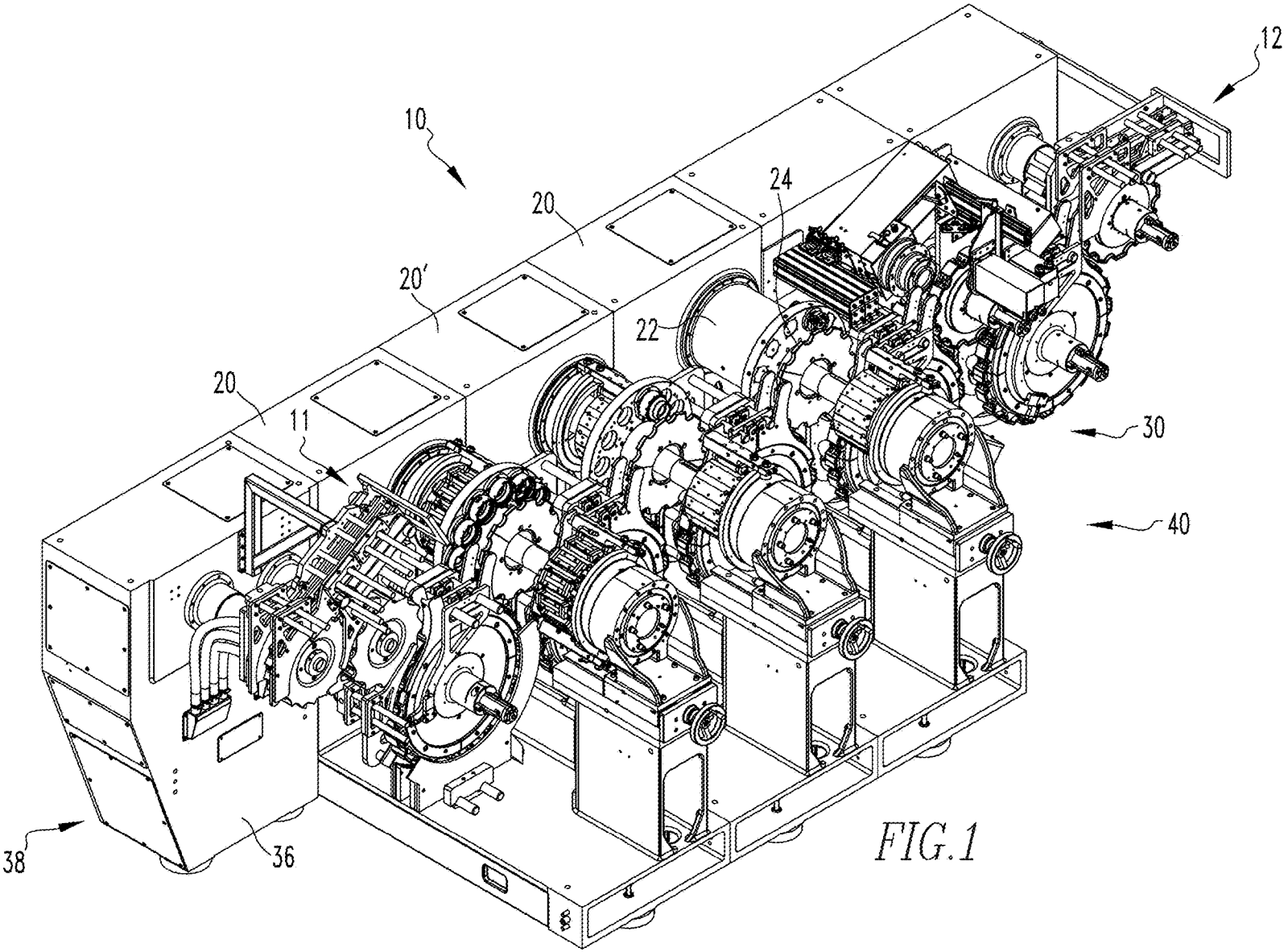
FIG. 1 is a perspective view of a necker machine in accordance with an example embodiment of the disclosed concept.

It will be appreciated that the specific elements illustrated in the figures herein and described in the following specification are simply exemplary embodiments of the disclosed concept, which are provided as non-limiting examples solely for the purpose of illustration. Accordingly, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. As used herein, "adjustably fixed" means that two components are coupled so as to move as one while maintaining a constant general orientation or position relative to each other while being able to move in a limited range or about a single axis. For example, a doorknob is "adjustably fixed" to a door in that the doorknob is rotatable, but generally the doorknob remains in a single position relative to the door. Further, a cartridge (nib and ink reservoir) in a retractable pen is "adjustably fixed" relative to the housing in that the cartridge moves between a retracted and extended position, but generally maintains its orientation relative to the housing. Accordingly, when two elements are coupled, all portions of those elements are coupled. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled."

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening is/are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). That is, for example, the phrase "a number of elements" means one element or a plurality of elements. It is specifically noted that the term "a 'number' of [X]" includes a single [X].

As employed herein, the terms "can" and "container" are used substantially interchangeably to refer to any known or suitable container, which is structured to contain a substance (e.g., without limitation, liquid, food, any other suitable substance), and expressly includes, but is not limited to, beverage cans, such as beer and beverage cans, as well as food cans.

As used herein, a "permanent coating" is a coating overlying all, or a portion of a surface or surfaces of a base material and that is coupled to the surface or surfaces of the base material in a manner such that the coating cannot be removed in a manner so as to be re-used (i.e., a permanent coating is not selectively coupled to the surface or surfaces of the base material).

Figure 2:
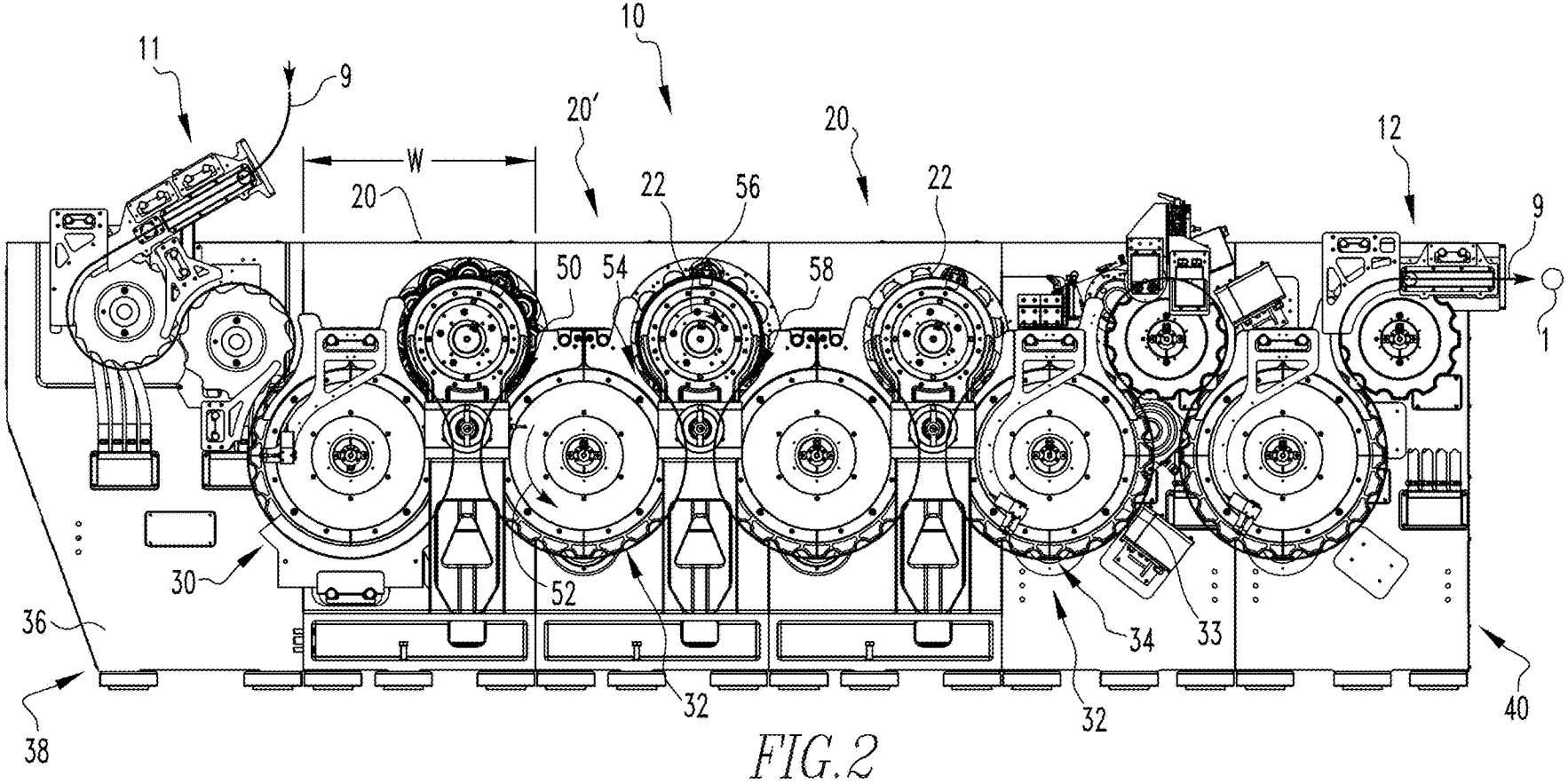
FIG. 2 is a front elevation view of the necker machine of FIG. 1.

As shown in FIGS. 1 and 2, a necker machine 10 in accordance with an example embodiment of the disclosed concept is structured to reduce the diameter of a portion of a can body 1. Necker machine 10 is of similar construction and operates in a similar manner as necker machines described in U.S. Pat. Nos. 11,370,015 and 11,565,303 (each commonly assigned to the same assignee as the present application) except for further details of particular aspects thereof such as provided below. Accordingly, only a general overview of major components of necker machine 10 and the general operation thereof is provided herein.

Figure 3:
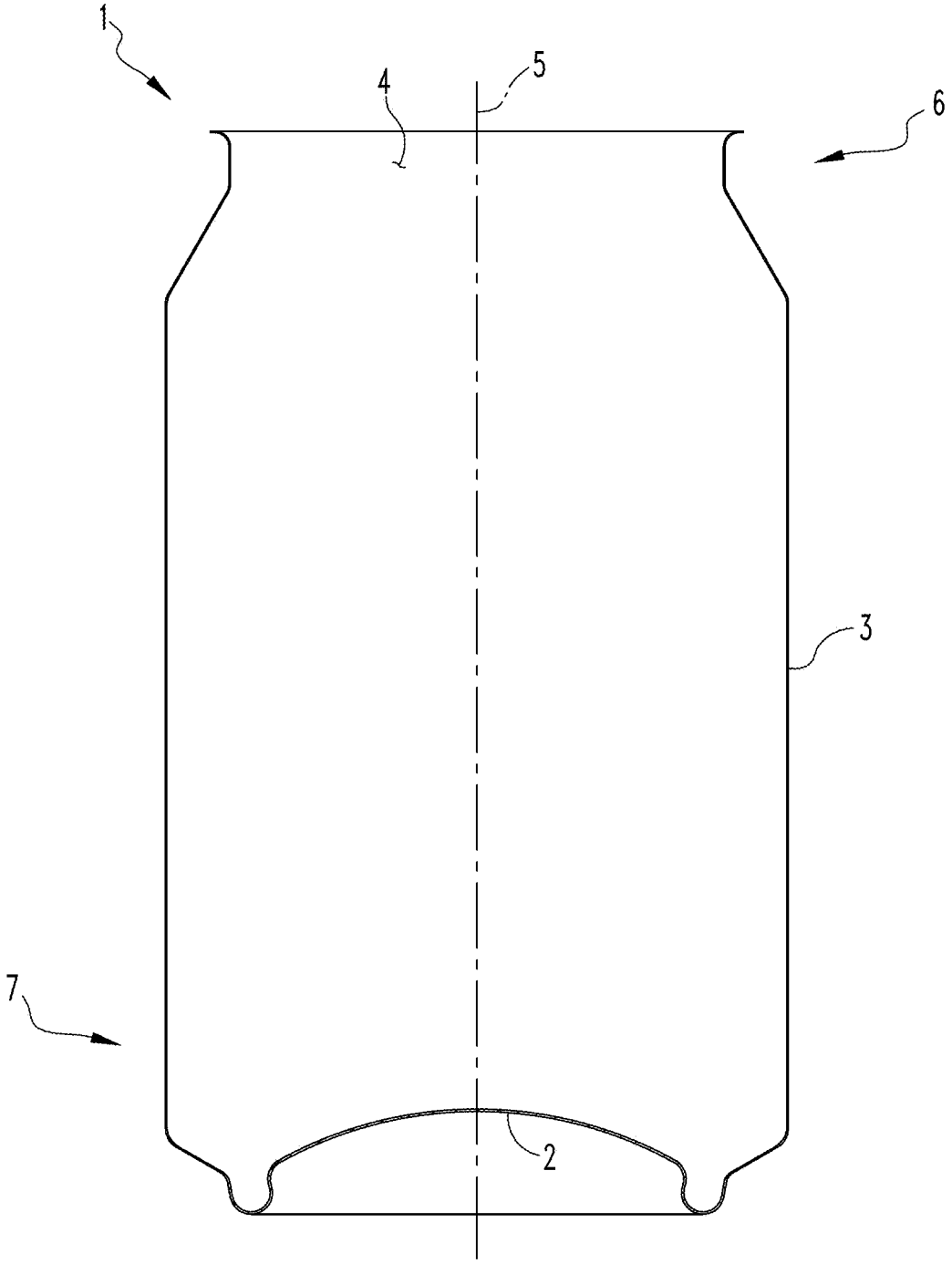
FIG. 3 is a schematic cross-sectional view of a can body.

As used herein, to "neck" means to reduce the diameter/radius of a portion of a can body 1. That is a can body 1, such as shown (for example, without limitation) in FIG. 3, includes a base 2 with an upwardly-depending sidewall 3. The base 2 and sidewall 3 define a generally enclosed space 4. In the embodiment discussed below, the can body 1 is a generally circular and/or an elongated cylinder. It is understood that this is only one exemplary shape and that the can body 1 can have other shapes. The can body 1 has a longitudinal axis 5. The sidewall 3 has a first end 6 and a second end 7. The base 2 is at the second end 7 and the first end 6 is open. The first end 6 initially has substantially the same radius/diameter as the sidewall 3, however following forming operations in the necker machine 10, the radius/diameter of the first end 6 is smaller than the other portions of the radius/diameter at the sidewall 3.

The necker machine 10 includes an infeed assembly 11, a plurality of processing/forming stations 20, a transfer assembly 30, and a drive assembly (not numbered). Hereinafter, processing/forming stations 20 are identified by the term "processing stations 20" and refer to generic processing stations 20. As is known, the processing stations 20 are disposed adjacent to each other and in series. That is, the can bodies 1 being processed by the necker machine 10 each move from an upstream location through a series of processing stations 20 in the same sequence. The can bodies 1 follow a path, hereinafter, the "work path 9" (FIG. 2). That is, the necker machine 10 defines the work path 9 wherein can bodies 1 move from an "upstream" location to a "downstream" location; as used herein, "upstream" generally means closer to the infeed assembly 11 and "downstream" means closer to an exit assembly 12. With regard to elements that define the work path 9, each of those elements have an "upstream" end and a "downstream end" wherein the can bodies move from the "upstream" end to the "downstream end." Thus, as used herein, the nature/identification of an element, assembly, sub-assembly, etc. as an "upstream" or "downstream" element or assembly, or, being in an "upstream" or "downstream" location, is inherent. Further, as used herein, the nature/identification of an element, assembly, sub-assembly, etc. as an "upstream" or "downstream" element or assembly, or, being in an "upstream" or "downstream" location, is a relative term.

Each processing station 20 has a similar width W (FIG. 2) and the can body 1 is processed and/or formed (or partially formed), i.e., "necked", as the can body 1 moves generally across the width. Generally, the processing/forming occurs in/at a turret 22. That is, the term "turret 22" identifies a generic turret. Each processing station 20 includes a non-vacuum starwheel 24 having a plurality of pockets 26. As used herein, a "non-vacuum starwheel" means a starwheel that does not include, or is not associated with, a vacuum assembly that is structured to apply a vacuum to the starwheel pockets 26. Further, each processing station 20 typically includes one turret 22 and one non-vacuum starwheel 24.

The transfer assembly 30 is structured to move the can bodies 1 between adjacent processing stations 20. The transfer assembly 30 includes a plurality of vacuum starwheels 32. As used herein, a "vacuum starwheel" means a starwheel assembly that includes, or is associated with, a vacuum assembly that is structured to apply a vacuum to the starwheel pockets 34. Further, the term "vacuum starwheel 32" identifies a generic vacuum starwheel 32. A vacuum starwheel 32 includes a disk-like body (FIG. 2) or a disk-like body assembly, and a plurality of pockets 34 disposed on the radial surface of the disk-like body 33. When used in association with generally cylindrical can bodies 1, the pockets 34 are generally semi-cylindrical. A vacuum assembly (not numbered), selectively applies suction to the pockets 34 and is structured to selectively couple a can body 1 to a pocket 34. It is understood, and as used herein, that "to apply a vacuum to a pocket 34" means that a vacuum (or suction) is applied to a starwheel pocket via at least one suitable passage. As such, components of the transfer assembly 30 such as, but not limited to, the vacuum starwheels 32 are also identified as parts of the processing stations 20. Conversely, the non-vacuum starwheel 24 of the processing stations 20 also move the can bodies 1 between processing stations 20 so the non-vacuum starwheels 24 are also identified as part of the transfer assembly 30.

It is noted that the plurality of processing stations 20 are structured to neck different types of can bodies 1 and/or to neck can bodies in different configurations. Thus, the plurality of processing stations 20 are structured to be added and removed from the necker machine 10 depending upon the need. To accomplish this, the necker machine 10 includes a frame assembly 36 to which the plurality of processing stations 20 are removably coupled. Alternatively, the frame assembly 36 includes elements incorporated into each of the plurality of processing station 20 so that the plurality of processing stations 20 are structured to be temporarily coupled to each other. The frame assembly 36 has an upstream end 38 and a downstream end 40. Further, the frame assembly 36 includes elongated members, panel members (neither numbered), or a combination of both. As is known, panel members coupled to each other, or coupled to elongated members, form a housing. Accordingly, as used herein, a housing is also identified as a "frame assembly 36."

Generally, each processing station 20 is structured to partially form (i.e., neck) the can body 1 so as to reduce the cross-sectional area of the can body first end 6 a predetermined amount. The processing stations 20 include some elements that are unique to a single processing station 20, such as, but not limited to, a specific die. Other elements of the processing stations 20 are common to all, or most, of the processing stations 20. The following discussion is related to the common elements and, as such, the discussion is directed to a single generic processing (forming) station 20' of the processing stations 20. It is understood, however, that any processing station 20 can include the elements discussed below.

Figure 4:
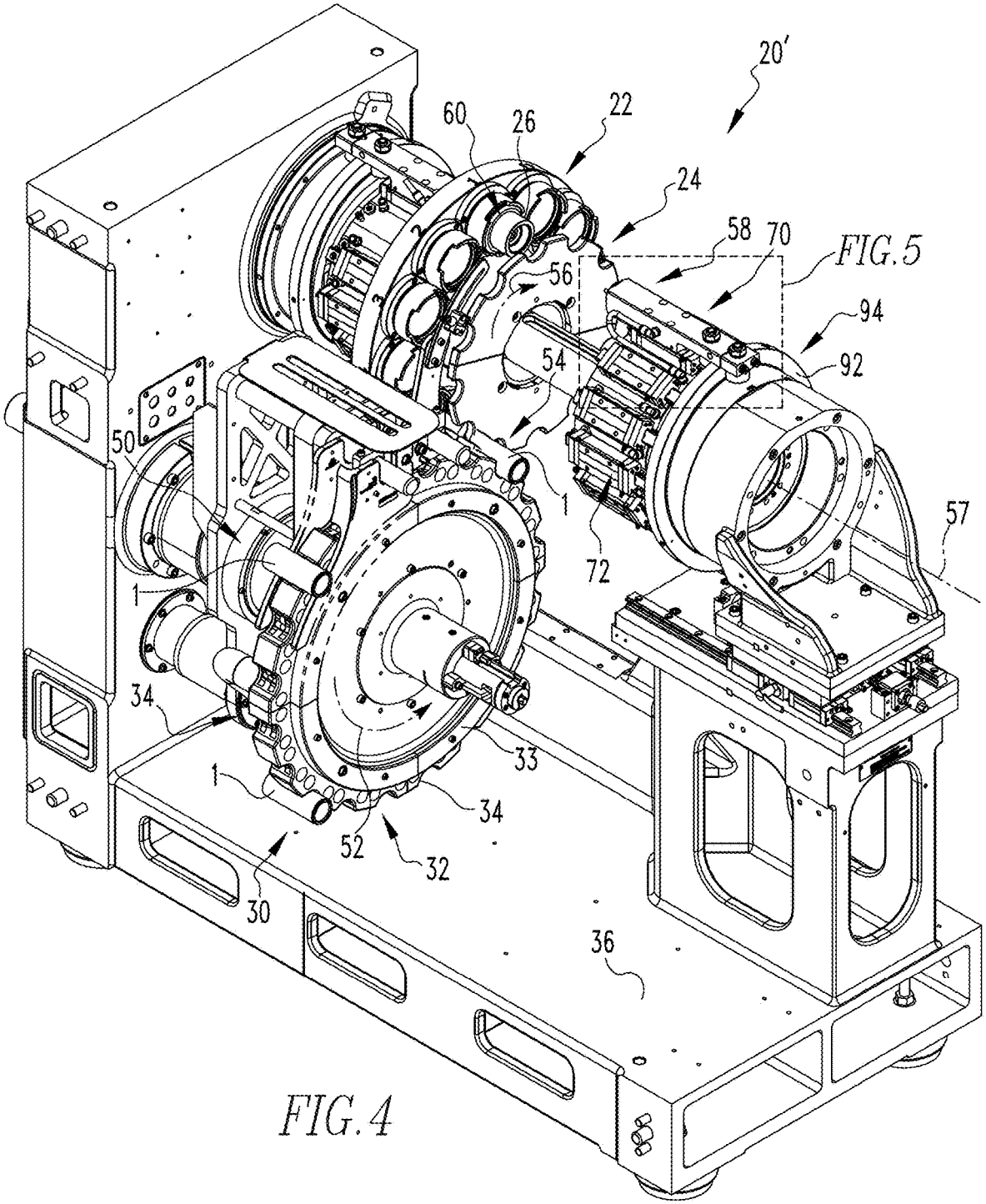
FIG. 4 is a partially schematic perspective view of a processing station of the necker machine of FIGS. 1 and 2.

Referring generally now to the isolated view of the representative processing station 20' of FIG. 4 (in addition to FIG. 3), during necking operations, a can body 1 is received in a pocket 34 of the vacuum starwheel 32 of the processing station 20' generally at a receiving point, such as generally indicated at 50. Depending on the positioning of the processing station, the can body 1 received at 50 may be received from an infeed assembly 11 or from a non-vacuum starwheel 24 of an adjacent processing station 20. The can body 1 moves with pocket 34 as the vacuum starwheel 32 rotates in a direction as shown by the arrow 52, until the can body 1 reaches a transfer point, such as generally indicated at 54, wherein the can body 1 transfers from a pocket 34 of the vacuum starwheel 32 to a pocket 26 of the non-vacuum starwheel 24 of the turret 22. The can body 1 then moves with the non-vacuum starwheel 24 as it rotates with the turret 22 in a direction as shown by the arrow 56 about a rotation axis 57, until the can body 1 reaches another transfer point, such as generally shown at 58, wherein the (now partially necked) can body 1 is transferred to the vacuum starwheel 32 of an adjacent downstream processing station 20. Accordingly, it is to be appreciated that transfer points 50 and 58 correspond among each processing station 20 of the necker machine 10.

While moving about the rotation axis 57 on the turret 22 and positioned in a pocket 26 of the starwheel 24, the first end 6 of the sidewall 3 of each can body 1 is engaged with a corresponding necking die 60 by a pusher arrangement 70 which translates the can body 1 parallel to the rotation axis 57. While only one necking die 60 and one complete pusher arrangement 70 are shown on turret 22 in FIG. 4, it is to be appreciated that a plurality of such elements disposed about turret are utilized in example embodiments of the disclosed concept (e.g., the arrangement of FIG. 4 would employ twelve necking dies 60 and twelve corresponding pusher arrangements 70).

Figure 5:
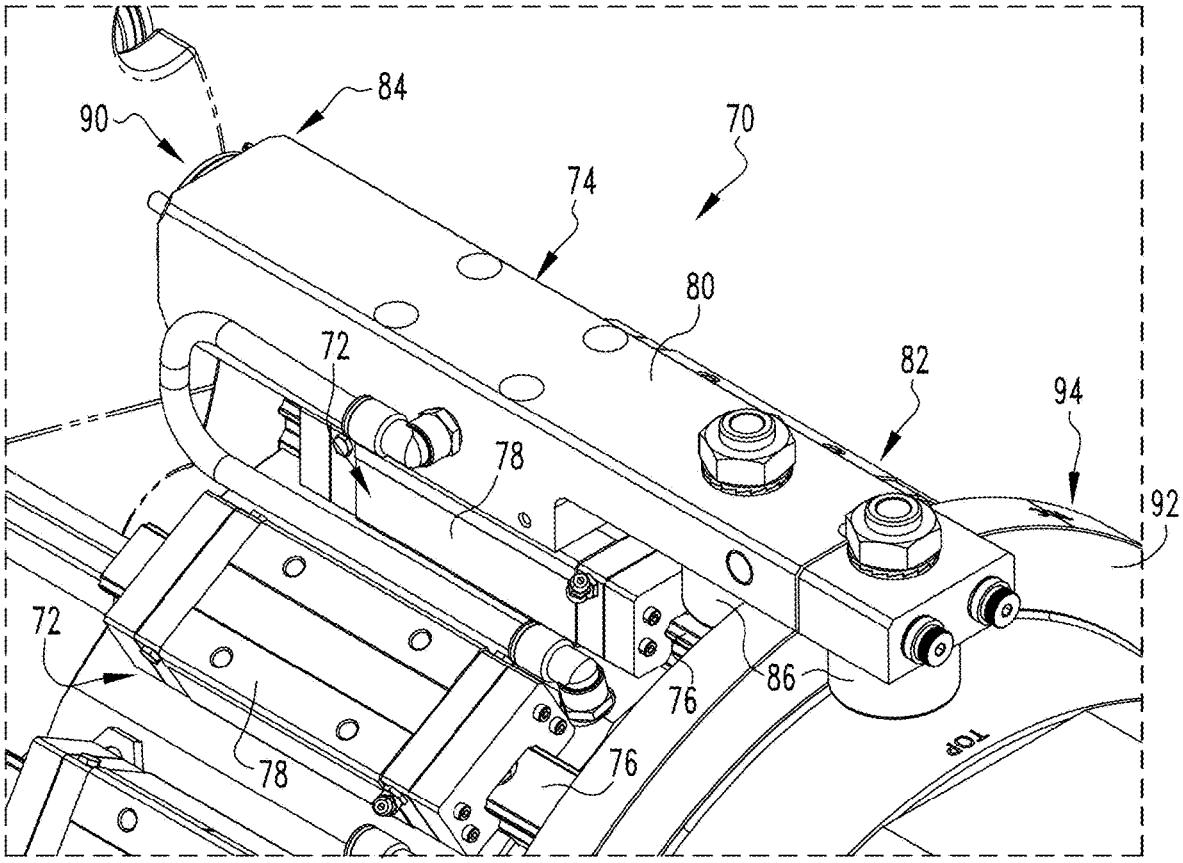
FIG. 5 is a detail view of a portion of the view of FIG. 4 such as indicated in FIG. 4 showing a pusher arrangement in accordance with an example embodiment of the disclosed concept.
Figure 6:
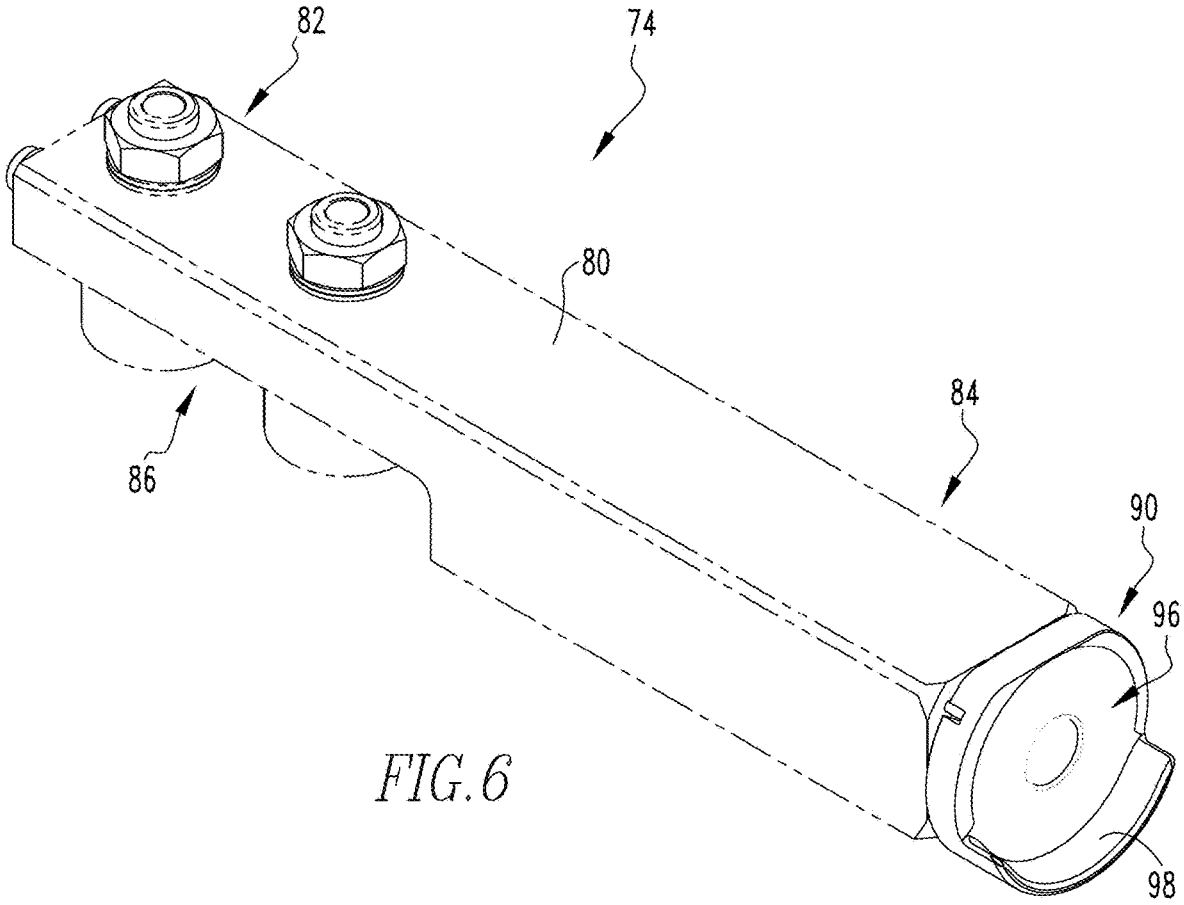
FIG. 6 is a perspective view of a pusher assembly of the pusher arrangement of FIGS. 4 and 5.

Referring to FIGS. 4-6, each pusher arrangement 70 includes a linear motion guide 72 and pusher assembly 74. The linear motion guide 72 includes a number of rail members 76 (the example of FIG. 5 utilizes a single rail member 76) rigidly coupled to the turret 22 parallel to the rotation axis 57. The linear motion guide 72 further includes a slider block 78 slidingly coupled to the number of rail members 76 so as to be readily translatable along the number of rail members 76 parallel to the rotation axis 57. In a non-limiting example embodiment of the disclosed concept, a linear motion guide 72 utilizing a SHS-LV Block as the slider block 78 and corresponding rail member such as manufactured by THK America, Inc. of Schaumburg, Illinois, has been employed as the linear motion guide 72, however it is to be appreciated that other suitable arrangements may be employed without varying from the scope of the disclosed concept.

Continuing to refer to FIGS. 4-6, the pusher assembly 74 includes a pusher ram 80 in the form of a generally elongated rigid body (e.g., formed from aluminum, composite, steel, or other suitable material) having a first end 82 and an opposite second end 84. The pusher ram 80 is rigidly coupled to the slider block 78 (e.g., via Allen bolts or other suitable arrangement) so as to be translatable with the slider block 78 parallel to the rotation axis 57. The pusher assembly 74 further includes a number of cam followers 86 (two are shown in the example of FIGS. 4-6) positioned at or about the first end 84 of the pusher ram 82 and a push pad 90 selectively coupled generally at or about the second end 86 of the pusher ram 82. In the example shown in FIGS. 4 and 5, the cam followers 86 are positioned so as to be disposed on opposing sides of a cam ridge 92 of a cam body 94 rigidly coupled to the frame assembly 36 of the processing station 20' so as to follow the cam profile defined by the ridge 92 as the turret 22 rotates about the rotation axis 57. It is to be appreciated that other follower/cam arrangements may be employed without varying from the scope of the disclosed concept.

Figure 7:
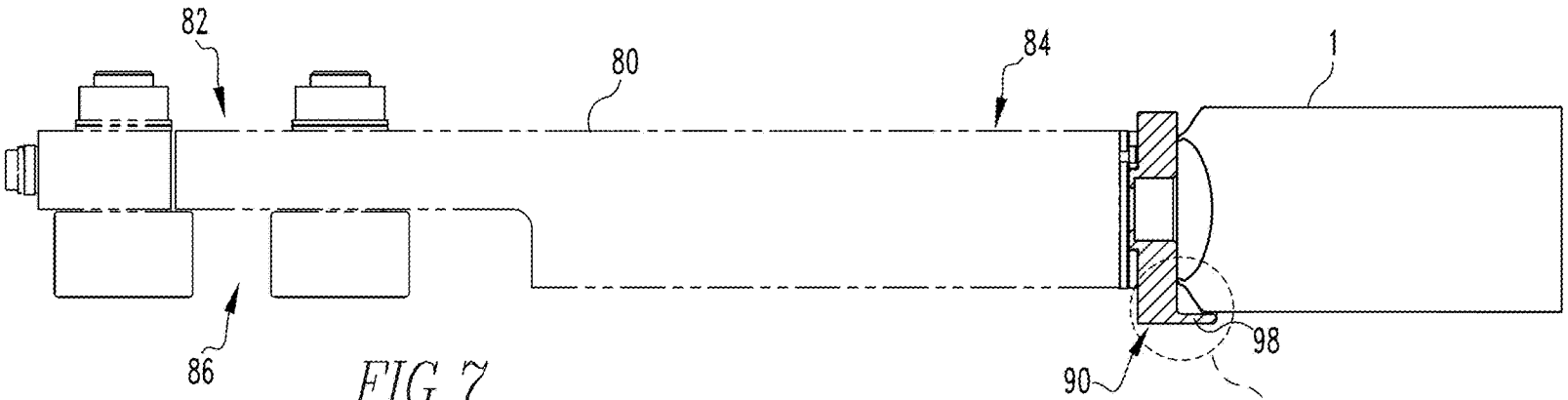
FIG. 7 is a side elevation view of the pusher assembly of FIG. 6 with a push pad thereof shown in section shown engaged with a can body in accordance with an example embodiment of the disclosed concept that has not undergone necking operations.
Figure 8:
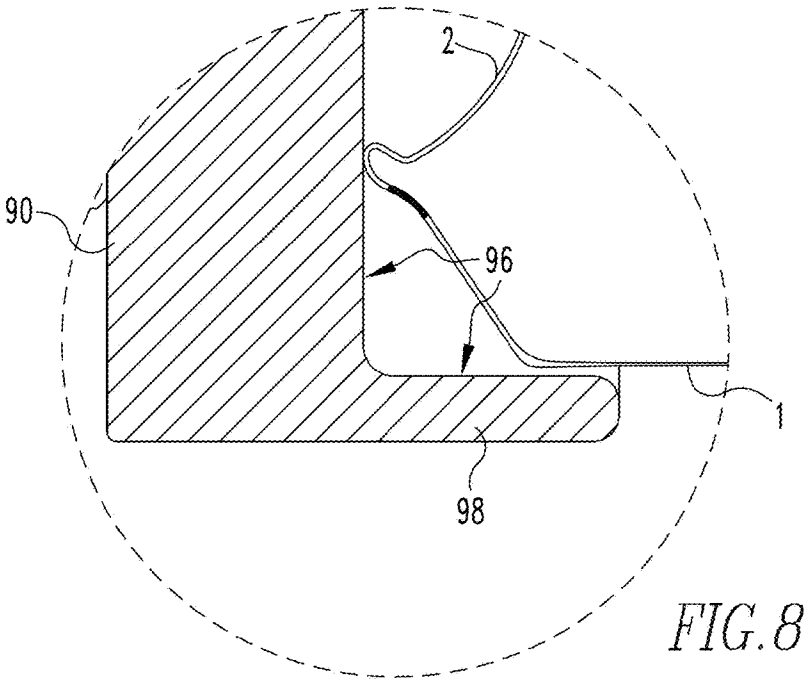
FIG. 8 is detail view of a portion of the view of FIG. 7 as indicated in FIG. 7.

Continuing to refer to FIG. 6, and additionally FIGS. 7 and 8, the push pad 90 includes a number of contact surfaces 96 which are structured to engage the base 2 of the can body 1 prior to, during, and after the first end 6 of the sidewall 3 of each can body 1 (FIG. 3) is engaged with the corresponding necking die 60 of the turret 22. In this example, the push pad 90 includes a generally thin, arcuate lip 98 extending outward therefrom to provide guidance/support, if necessary, to the can body 1, however it is to be appreciated that other arrangements of the push pad 90 may be employed without varying from the scope of the disclosed concept.

In order to combat aluminum build up from can bodies 1 on the push pad 90 (such as discussed previously in the Background section herein), the contact surfaces 96 thereof comprise a smooth ceramic material (e.g., without limitation, ceramic grades such as WZ-HS and YZ-110 HS). The smoothness of the ceramic surface is less likely to result in aluminum adherence thereto. In the event that aluminum does build up over time on the ceramic material, the push pad 90 may be uncoupled from the pusher ram 80 and placed in a caustic bath that dissolves the built-up aluminum but does not harm the ceramic material. In this way, any aluminum build up on the push pad 90 may be readily removed leaving the push pad 90 ready to be placed back into service. Hence, it is to be appreciated that through such operation, potential aluminum build-up on the push pad 90 after an axially based reforming operation is minimized and readily rectified.

Figure 9:
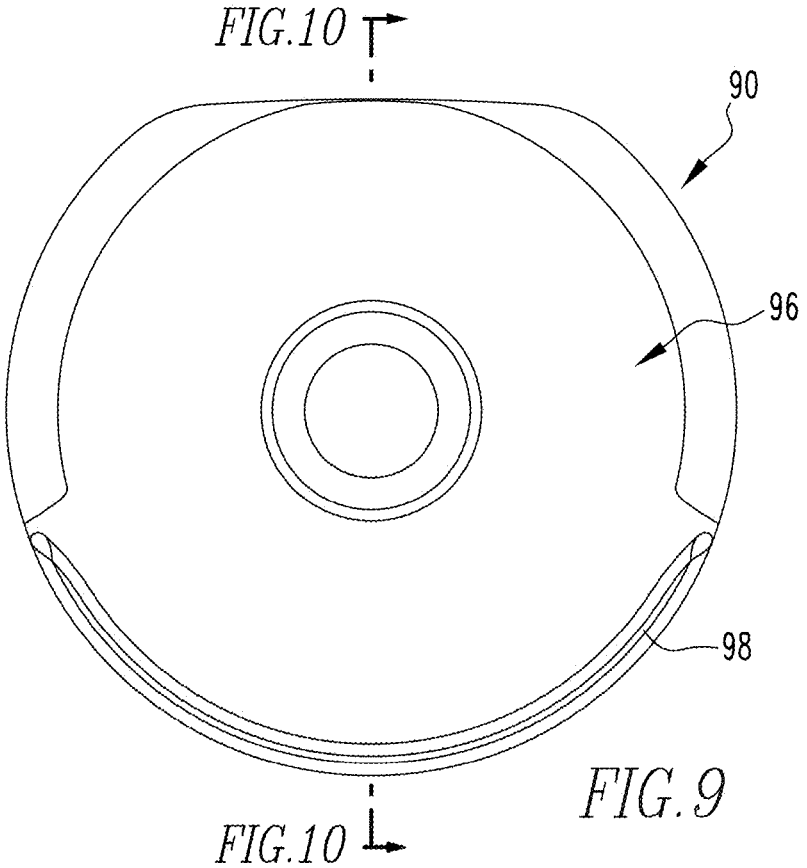
FIG. 9 is an end elevation view of a push pad of the pusher assembly of FIGS. 6-8.
Figure 10:
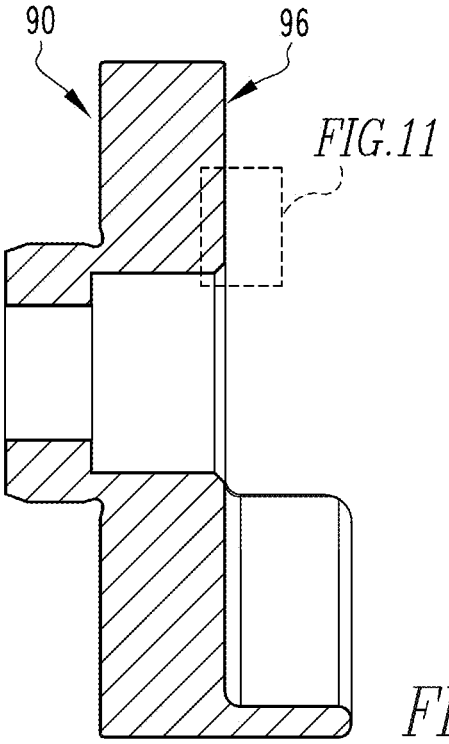
FIG. 10 is a sectional view of the push pad of FIG. 9 taken along the line indicated in FIG. 9.
Figure 11:
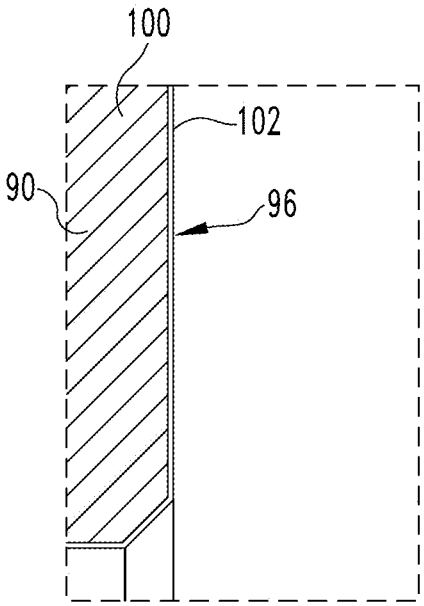
FIG. 11 is a detail view of a portion of the view of FIG. 10 as indicated in FIG. 10.

It is to be appreciated that such construction/arrangement of the push pad 90 may be accomplished in several ways without varying from the scope of the disclosed concept. For example, in the embodiment shown in FIGS. 7 and 8, the push pad 90 is formed as a unitary body of ceramic material (s), hence all of the contact surfaces 96 thereof are thus the aforementioned ceramic material. As another example, such as shown in FIGS. 9-11, the push pad 90 may be formed as a base portion 100 of a preferably non-ceramic base material (e.g., without limitation, steel) having all or selected portions of the surface(s) thereof (e.g., the contact surface(s) 96) having a permanent ceramic coating 102 thereon. An example of such arrangement may be readily formed (for example, without limitation) by immersing a steel base portion 100 in a bath of sodium hydroxide, thus acquiring a ceramic layer 102 on the steel base portion 100. It is noted that in such examples, any surfaces not particularly coated with a ceramic layer (perhaps due to cost or other constraints) would need to be otherwise protected before placement in a caustic bath.

Figure 12:
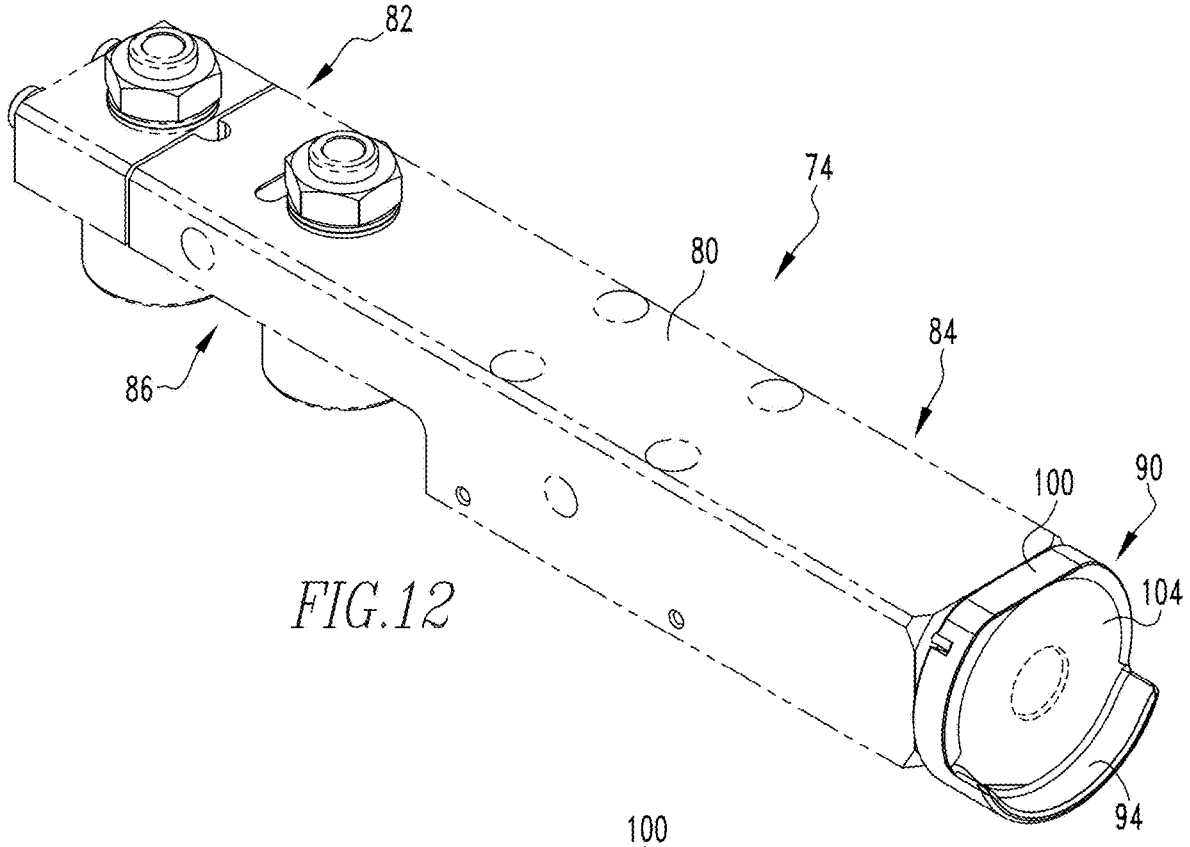
FIG. 12 is a perspective view of another pusher assembly in accordance with another example embodiment of the disclosed concept.
Figure 13:
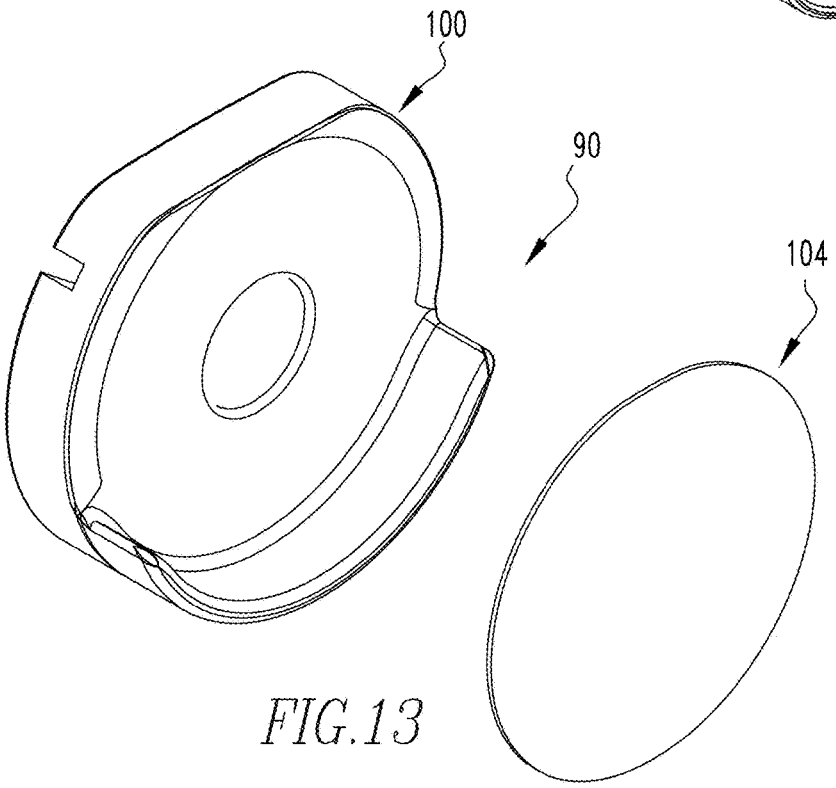
FIG. 13 is an exploded perspective view of a push pad of the pusher assembly of FIG. 12.

As yet a further example, such as shown in FIGS. 12 and 13, the push pad 90 may be formed as a generally modular arrangement having a base portion 100 (e.g., without limitation, formed from a preferably non-ceramic material, e.g., without limitation, steel) with a number of removable portions 104 formed from a ceramic material selectively coupled to the base portion 100 (e.g., via one or more suitable fastener(s)). Such arrangement allows for the ceramic portion(s) to be readily cleaned (e.g., such as described above) or replaced as needed. In the particular example shown in FIGS. 12 and 13, a single removeable portion 104 formed of a ceramic material and having a disc shape is utilized, however it is to be appreciated that one or more of the quantity, shape, sizing, etc. of the removeable portion(s) utilized in a given embodiment may be varied without varying from the scope of the disclosed concept.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of disclosed concept which is to be given the full breadth of the claims appended and any and all equivalents thereof.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A push pad for use in forming a can body, the push pad comprising:

a contact surface structured to engage the can body, wherein the contact surface comprises a ceramic material, a base body; and a number of removeable portions selectively coupled to the base body, wherein the number of replaceable portions comprises the contact surface.

2. The push pad of claim 1, wherein the push pad is a unitary body comprising the ceramic material.

3. The push pad of claim 1 comprising a base body formed from a non-ceramic material, wherein the contact surface is a permanent coating on the base body.

4. The push pad of claim 1, wherein the number of removeable portions comprise a single, disc-shaped element.

5. A pusher assembly for use in forming a can body, the pusher assembly comprising:

a pusher ram having a first end and an opposite second end;

a number of cam followers positioned at or about the first end of the pusher ram, the number of cam followers structured to follow a cam profile; and a push pad coupled to the second end of the pusher ram, the push pad having a contact surface structured to engage the can body, wherein the contact surface comprises a ceramic material, a base body; and a number of removeable portions selectively coupled to the base body, wherein the number of replaceable portions comprises the contact surface.

6. The pusher assembly of claim 5, wherein the push pad is a unitary body comprising the ceramic material.

7. The pusher assembly of claim 5, wherein the push pad comprises a base body formed from a non-ceramic material, and wherein the contact surface is a permanent coating on the base body.

8. The pusher assembly of claim 5, wherein the number of removeable portions comprise a single, disc-shaped element.

9. A pusher arrangement for use in forming a can body, the pusher arrangement comprising:

a linear motion guide comprising:

a number of rail members; and a slider block slidingly coupled to the number of rail members so as to be readily translatable along the number of rail members; and a pusher assembly comprising:

a pusher ram rigidly coupled to the slider block, the pusher ram having a first end and an opposite second end;

a number of cam followers positioned at or about the first end of the pusher ram, the number of cam followers structured to follow a cam profile; and a push pad coupled to the second end of the pusher ram, the push pad having a contact surface structured to engage the can body, wherein the contact surface comprises a ceramic material, a base body; and a number of removeable portions selectively coupled to the base body, wherein the number of replaceable portions comprises the contact surface.

10. The pusher arrangement of claim 9, wherein the push pad is a unitary body comprising the ceramic material.

11. The pusher arrangement of claim 9, wherein the push pad comprises a base body formed from a non-ceramic material, and wherein the contact surface is a permanent coating on the base body.

12. The pusher arrangement of claim 9, wherein the number of removeable portions comprise a single, disc-shaped element.

13. A processing station for forming a portion of a can body, the processing station comprising:

a frame;

a turret rotatably coupled to the frame and selectively rotatable about a rotation axis;

a cam body rigidly coupled to the frame, the cam body having a portion defining a cam profile; and a pusher arrangement comprising:

a linear motion guide comprising:

a number of rail members rigidly coupled to the turret parallel to the rotation axis; and a slider block slidingly coupled to the number of rail members so as to be readily translatable along the number of rail members parallel to the rotation axis; and a pusher assembly comprising:

a pusher ram rigidly coupled to the slider block, the pusher ram having a first end and an opposite second end;

a number of cam followers positioned at or about the first end of the pusher ram, the number of cam followers structured to follow the cam profile of the cam body; and a push pad coupled to the second end of the pusher ram, the push pad having a contact surface structured to engage the can body, wherein the contact surface comprises a ceramic material.

14. The processing station of claim 13, wherein the push pad is a unitary body comprising the ceramic material.

15. The processing station of claim 13, wherein the push pad comprises a base body formed from a non-ceramic material, and wherein the contact surface is a permanent coating on the base body.

16. The processing station of claim 13, wherein the number of removeable portions comprise a single, disc-shaped element.

* * * * *